US006052849A

United States Patent [19]

Dixon et al.

[11] Patent Number: 6,052,849

[45] Date of Patent: Apr. 25, 2000

[54] METHOD AND APPARATUS TO PREVENT POSITIONAL PLAGIOCEPHALY IN INFANTS

[75] Inventors: Donald L. Dixon, Anchorage, Ky.; Robert L. Havens, Marysville, Ind.

[73] Assignee: Center for Orthotic & Prosthetic Care, L.L.C., Louisville, Ky.

[21] Appl. No.: 09/040,954

[22] Filed: Mar. 18, 1998

[51] Int. Cl.[7] ..... A47C 20/00; A47G 9/02

[52] U.S. Cl. ..... 5/643; 5/655

[58] Field of Search ..... 5/638, 640, 643, 5/724, 725, 655, 491

[56] References Cited

U.S. PATENT DOCUMENTS

| | | | |
|---|---|---|---|
| 808,217 | 12/1905 | Reich | 5/640 |
| 923,862 | 6/1909 | Langworthy . | |
| 958,502 | 5/1910 | Kennedy | 5/643 X |
| 1,935,034 | 11/1933 | Law | 5/643 X |
| 2,674,996 | 4/1954 | Stowell et al. | 128/75 |
| 2,695,415 | 11/1954 | Holton | 5/345 |
| 3,403,413 | 10/1968 | Calhoun et al. | 5/638 |
| 4,776,324 | 10/1988 | Clarren | 128/76 |
| 5,094,229 | 3/1992 | Pomatto et al. | 602/17 |
| 5,308,312 | 5/1994 | Pomatto et al. | 602/17 |
| 5,329,934 | 7/1994 | Bowman | 128/845 |
| 5,406,655 | 4/1995 | Sahlin | 4/572.1 |
| 5,561,876 | 10/1996 | Petruzella | 5/724 |
| 5,566,407 | 10/1996 | Lien | 5/655 X |
| 5,857,232 | 1/1999 | Mahdavi | 5/655 |

FOREIGN PATENT DOCUMENTS

| | | | |
|---|---|---|---|
| 001061219 | 8/1979 | Canada | 5/638 |

OTHER PUBLICATIONS

Andrew E. Turk, M.D.; Joseph G. McCarthy, M.D.; Charles H. M. Thorne, M.D.; Jeffrey H. Wisoff, M.D.; The "Back to Sleep Campaign" and Deformation Plagiocephaly: Is There Cause for Concern?, Journal of Craniofacial Surgery vol. 7(1): Jan. 12–18, 1996.

Louis C. Argenta, M.D.; Lisa R. David, M.D.; John A. Wilson, M.D.; William O. Bell, M.D., An Increase in Infant Cranial Deformity with Supine Sleeping Position, Journal of Craniofacial Surgery V. 7(1): Jan. 5–11, 1996.

Reisner et al., Cranial Asymmetry in Infants: Is the Increased Incidence Related to the "Back to Sleep" Campaign?, University of Louisville School of Medicine, Perinatal Coordinating Center, vol. XXIV, No. 8, Aug. 1997.

Richard J. Bruneteau, M.D.; John B. Mulliken, M.D., Frontal Plagiocephaly: Synostotic, Compensational, or Deformational, Plastic and Reconstructive Surgery v. 89(1) pp. 21–31 Jan. 1992.

Sterling K. Clarren, M.D., Plagiocephaly and torticollis: Etiology, natural history, and helmet treatment, The Journal of Pediatrics vol. 98(1) pp. 92–95 Jan. 1981.

John Kattwinkel, M.D.; John Brooks, M.D.; David Myerberg, M.D., Positioning and SIDS, Pediatrics vol. 89 No. 6, 1120–1126 Jun. 1992.

(List continued on next page.)

*Primary Examiner*—Michael F. Trettel
*Attorney, Agent, or Firm*—Wood, Herron & Evans, L.L.P.

[57] ABSTRACT

A cranial suspension apparatus to prevent positional plagiocephaly in an infant by distributing loads on the head of the infant lying in the supine position on a horizontal surface. The infant is placed in the apparatus such that the head of the infant is supported on a flexible porous support material with the tension of the material adjusted to support the head just above or just touching the sleep surface. The flexible porous support material may be a net with an open weave. The apparatus prevents localized pressure on the infant's head in an area contacting a sleep surface when infants are routinely placed in the supine position, which is recommended to avoid sudden infant death syndrome.

18 Claims, 2 Drawing Sheets

OTHER PUBLICATIONS

Kattwinkel, John et al., Positioning and Sudden Infant Death Syndrome (SIDS): Update, Pediatrics, vol. 98 No. 6, 1216 Dec. 1996.

Alex A. Kane, M.D.; Laura E. Mitchell, Ph.D.; Kathleen P. Craven, R.N., M.S.N; Jeffrey L. Marsh, M.D., F.A.A.P., Observations on a Recent Increase in Plagiocephaly Without Synostosis, Pediatrics vol. 97 No. 6 pp. 877–885 Jun. 1996.

Peter Robson, Persisting Head Turning in the Early Months: Some Effects in the Early Years, Developmental Medicine and Child Neurology vol. 10, pp. 82–92 1968.

P. M. Danby, Plagiocephaly in some 10–year–old Children, Archives of Disease in Childhood vol. 37, pp. 500–504 1962.

METHOD AND APPARATUS TO PREVENT POSITIONAL PLAGIOCEPHALY IN INFANTS

FIELD OF THE INVENTION

The invention relates to an apparatus and the use of the apparatus to prevent positional plagiocephaly by more evenly distributing loads on the head of an infant lying on a sleep surface in the supine position.

BACKGROUND OF THE INVENTION

Cranial asymmetry (plagiocephaly) and deformations are common in the neonatal period. They may occur from various causes including premature closure of the cranial vault and/or skull base sutures (craniosynostosis), syndromal craniofacial dysostosis, intracranial volume disorders such as hydrocephalus, microcephaly or tumor, metabolic bone disorders such as rickets, and birth trauma such as depressed skull fractures. A subset of patients with plagiocephaly are recognized that do not exhibit pathology of the sutures and do not fall into any of the above categories. These patients are referred to as having plagiocephaly without synostosis (PWS), also known as "positional" or "gestational" plagiocephaly.

PWS is characterized by unilateral occipital flattening with contralateral occipital bulging or, put more simply, a flat spot at the back of the infant's head. As the deformation becomes more severe there is ipsilateral forehead protrusion, contralateral forehead flattening and endocranial skull base rotation with anterior displacement of the ipsilateral ear. The face becomes involved with anterior rotation of the cheek and mandible away from the side of involvement. If not corrected by one year of age, these deformities typically do not improve and remain into adulthood as proven by anthropometric measurements, though they are less noticeable secondary to camouflage by the hair.

The etiology of cranial asymmetry in PWS has been suggested to result from two possible mechanisms. One proposed mechanism is intrauterine constraint that develops from early descent of the fetal head into the pelvis, effectively placing uneven pressure on one area of the cranium within a confined space. This leads to constraint of one side of the occiput (back of the head) with a compensatory change to the contralateral skull. Another mechanism that can perpetuate the fetal constraint or even lead to the misshapen head is supine positioning of the infant. Once the occiput develops even a mildly flattened area, placing the infant on the back or supine position will perpetuate the deformity. The head will roll to the flattened area by the forces of gravity and, because motor control is lacking in the neonate, the deformity will remain or worsen. This effect is especially illustrated in infants with neuromuscular disorders and hypotonia where deformation of the cranium can be quite profound. This phenomena has been recognized for many years and recommendations for changing the infant's environment with relationship to the crib and placement within the sleeping area are well established.

An increased number of patients diagnosed with PWS after clinical and radiological evaluation resulted from a sudden increase of infant referrals from pediatricians and primary care specialists. This increase in referrals contemporaneously corresponded to the "Back-to-Sleep" campaign by the American Academy of Pediatrics (AAP), recommending that infants be placed in the supine (lying on the back) sleeping position in an effort to decrease the incidence of sudden infant death syndrome (SIDS). Similar findings in regard to referral patterns for patients with PWS and the timing of the AAP "Back-to-Sleep" campaign have been reported from numerous craniofacial centers around the country. For example, national statistics show a decrease in infant prone (lying on the stomach) sleeping position prevalence from 70% in 1992 to 24% in 1996. This decrease correlated with a 15–20% decrease in the incidence of SIDS.

SIDS is the leading cause of early infantile deaths in the United States. Approximately 6,000 infants die of this syndrome each year, an incidence of 1.2 deaths per 1,000 live births. Based on these data, the AAP Task Force on Infant Positioning and SIDS recommended that efforts be made to inform parents to place infants in the supine position, avoiding even a side position, to further lower the risk. The report recognized the increased incidence of flat spots on the occiput and recommended altering the baby's supine sleeping position by changing the orientation of the baby to the side or stomach during waking hours.

A causal relationship between the "Back to Sleep" campaign and PWS remains presumptive and is largely based on a temporal relationship. Although the issue of how the supine sleep position adversely affects the lambdoid suture remains unclear, it is reasonable to assume that the mechanism is related to a disturbance of sutural function and skull growth. Craniofacial anomalies secondary to suture pathology demonstrate the complex relationships that exists among skull, brain and facial development. Alterations in the normal growth pattern of one component can produce significant changes in others. In the case of synostosis or retardation of growth of the lambdoid suture, as is thought to occur in PWS, skull growth perpendicular to the dysfunctional suture is impeded and the occipital region on the side of the cranial suture becomes flattened. This observation dates back to 1851, when Virchow recognized that the shape of the skull deformations was predictable in cases of craniosynotosis depending on which suture was prematurely fused. He noted that not only was the skull growth retarded parallel to the abnormal suture, but that skull growth was enhanced in a perpendicular plane. Thus, in cases of lambdoid synostosis or untreated PWS, cranial growth is exaggerated in a frontal direction on the same side (ipsilateral frontal bossing) and in a posterior direction on the opposite side (contralateral occipital bossing). These changes are the result of the normal brain growth that exerts a force on the pliable cranium of the infant.

The clinical features of an infant with PWS are best appreciated when the child is examined from above, looking down on the vertex of the head. From this view, the skull has a trapezoid or parallelogram shape. Occipital bossing, contralateral occipital bulging, and ipsilateral frontal bossing are the most prominent features. This asymmetry may not be readily appreciated when the child is examined "face-on." The anterior compensatory cranial growth which results in frontal bossing also results in forward displacement of the petrous bone, which houses the ear and the temporomandibular joint. Infants with PWS frequently have forward and inferior displacement of the ear on the same side as the occipital flattening and deviation of the chin to the opposite side. An area of alopecia is frequently noted and marks the site of continuous head positioning.

The natural history of PWS is unknown. There is no evidence to suggest that single suture closure or dysfunction impedes brain growth and development. Infants with PWS have normal neurologic evaluations, no signs of raised intracranial pressure, and age appropriate developmental milestones. Further, the head circumference is typically within the normal range. Treatment is indicated, nevertheless, to alleviate the cosmetic and other effects on the growing child.

The treatment of PWS depends mainly on the infant's age and the degree of cranial distortion. The initial management of PWS is based on clinical rather than radiographic criteria, since skull x-rays are neither sufficiently sensitive nor specific to detect sutural abnormalities. The younger the infant and the less severe the skull asymmetry, the more likely the child will respond to conservative non-surgical treatments. Young infants (less than three months of age) who have occipital flattening are treated with repositioning only. Parents are instructed to keep the child off the flattened head region by using various repositioning maneuvers with a warning that the infant will initially resist these attempts. In the majority of cases, repositioning the infant on the opposite occipital region or in a lateral position is successful with some coaxing after several days and is usually all that is required. The head assumes a more normal symmetric shape with further cranial growth.

Older infants (more than three months of age) and those who have not responded to repositioning are placed in an individually tailored Cranial Augmentation Device or cranial molding helmet. The helmet is a custom fitted apparatus that is designed to apply continuous pressure to the cranium. This apparatus has proved to be very effective in allowing the growing brain to reshape the still-malleable cranium. It is applied continuously and removed only for bathing until the child is twelve months old. After twelve months of age or if the deformity is severe, molding helmets are of little value and surgical cranial recontouring is required.

Education of the parents regarding the importance of head repositioning should result in a reduction in positional PWS. Positional plagiocephaly is preventable by judicious and consistent manipulation of the infant's head. Such constant literal "hands-on" intervention is, however, impractical or impossible in many cases. Examples of such cases are during the many hours that an infant is asleep and/or while the infant is in the care of a less than vigilant caregiver. Thus, a cranial support apparatus to either supplement or replace constant hands-on intervention for the prevention or mitigation of PWS in an infant is needed.

Stated in another way, the supine or "on the back" sleeping position of infants, preferred to preclude the possibility of SIDS, may itself cause positional plagiocephaly or PWS, that is, malformation in the shape of the head of an infant. This malformation can be cosmetically distracting and functionally disruptive even into adulthood. It is thus desired to provide a method and apparatus which prevents PWS in infants and thus removes a potentially debilitating side effect from the well known measure of putting an infant to sleep on his or her back to prevent SIDS.

SUMMARY OF THE INVENTION

The invention is directed to a method and apparatus that prevents positional plagiocephaly in infants by spreading out over a defined range the load that is placed on a infant's head when the infant lies on his or her back on a sleep surface. The method is safe, inexpensive, and is easy to use.

The method comprises supporting the infant's head in a flexible porous material such as a net where the head is partially surrounded by the material. By adjusting the tension in the net or other material, the method and apparatus allows distribution of forces across a defined area at the back of the infant's head. Depending upon the size and weight of the infant's head, the area that will be supported ranges from about six square inches to about twenty-five square inches and corresponds to about 15% to about 25% of the head surface area. The force exerted on the infant's head ranges from about 0.2 pounds per square inch (psi) to about 0.6 psi. In a preferred embodiment the material is suspended above a sleep surface and across a frame and the infant's head is supported in a position between the frame and the sleep surface just touching the sleep surface. In another embodiment, the infant's head is supported in the material just above the sleep surface.

The invention is further directed to an apparatus for preventing positional plagiocephaly in infants. The apparatus is a frame and a flexible porous material such as a net that is fitted over the frame to provide a yieldable head-supporting surface. The material is depressible by the head below the frame portion for supporting the head and distributing support forces acting on the head through the material. The tension in the material is adjustable by stretching the material tighter or looser about the frame to provide a varying amount of support on the portion of the head that the material contacts. In one embodiment, the frame is disposed about five inches above the sleep surface and the material is depressible downwardly from the frame to a lowest position just contacting the sleep surface. The frame and material are preferably portable and adaptable for use on any horizontal sleep surface.

There is thus briefly summarized a safe, inexpensive, easy to use apparatus and methods of using the apparatus to support the head of a sleeping infant for preventing flat spots on the back of the infant's head, known as positional plagiocephaly. The invention will be further appreciated in light of the following drawings and detailed description.

DETAILED DESCRIPTION

Figure 1:
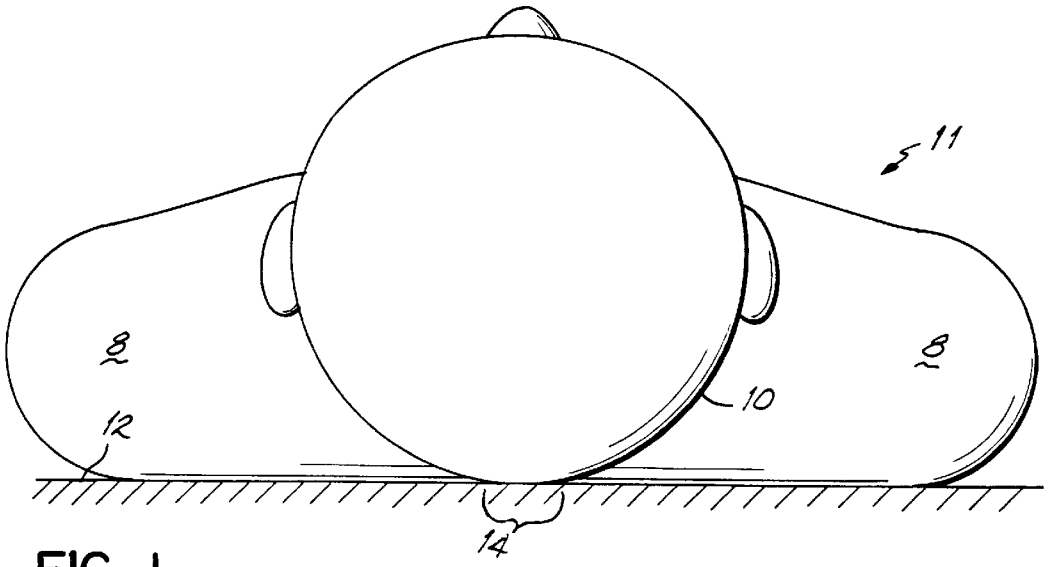
FIG. 1 is a schematic elevational view of the head of an infant in a supine position.

FIG. 1 shows the shoulders 8 and head 10 of an infant 11 in contact with a sleep surface 12 when the infant 11 is lying in the supine position, that is, lying on the back with the face upward. In this position, an area of the occiput 14 (back of the head 10) that contacts the sleep surface 12 may be abnormally formed or flattened. This may result in positional plagiocephaly or plagiocephaly without synostosis (PWS) resulting from localized loads on an area of the occiput 14 when the infant 11 is regularly placed on the sleep surface 12 in a supine position. The sleep surface 12 is broadly defined to encompass any substantially horizontal surface on which the infant 11 is placed in the supine position in a sleeping or waking state. The sleep surface 12 may thus include a table, a crib, a stroller, a mattress and so on.

Figure 2:
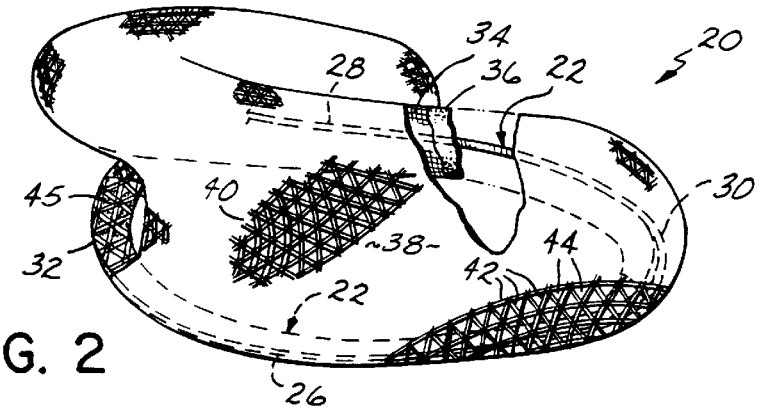
FIG. 2 is a perspective view of the cranial suspension apparatus according to the invention.

With reference to FIG. 2 the cranial suspension apparatus 20 of the invention is shown. The apparatus 20 consists of a frame 22 for suspending a porous support material to be discussed below and the porous support material suspended thereon. The frame 22 is configured as a continuous asymmetric double U having a bottom portion 26 and a top portion 28, with the top portion 28 higher than the bottom portion 26. The bottom portion 26 is placed on the sleep surface 12 and the top portion 28 suspends the porous support material. This configuration allows less pressure in the area between the occipital region and the neck when an infant 11 is placed in the apparatus 20.

Figure 2A:
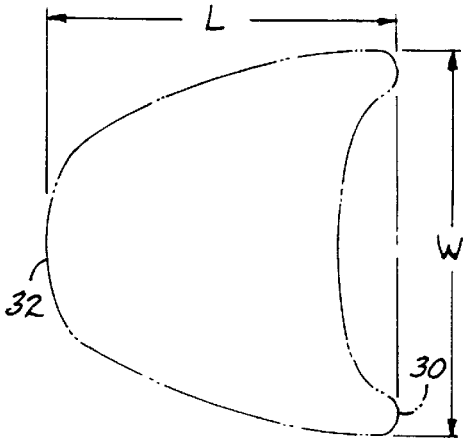
FIG. 2A is a diagrammatic two-dimensional plan view representation of the length and width of the apparatus.
Figure 2B:
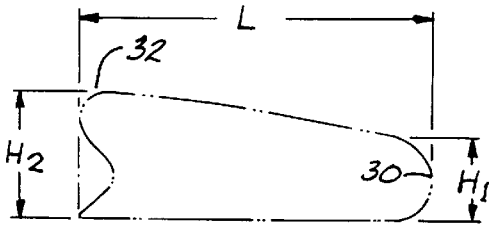
FIG. 2B is a diagrammatic two-dimensional elevational representation of the length and height of the apparatus.

As best shown in FIG. 2A, the frame 22 is about ten inches to about fourteen inches in length L, preferably about eleven inches, and is about ten inches to about fourteen inches in width W, preferably about twelve inches. As best shown in FIG. 2B, the frame height is about two and one-half inches $H_1$ at the end 30 nearest the infant's 11 shoulders 8, and the height is about four inches $H_2$ at the end 32 farthest from the infant's 11 shoulders 8. The apparatus 20 having the aforementioned dimensions has several advantages. The apparatus 20 will accommodate an infant 11 from birth to about four months of age and thus supports the head 10 during the period when positional intervention is most likely to be successful in preventing PWS. Another advantage is that the apparatus 20 will fit on most sleep surfaces 12. An additional advantage is that the apparatus 20 is easily portable and thus can be conveniently transported for use on different sleep surfaces 12 so that consistent use of the apparatus 20 is facilitated.

While the frame 22 may be made of any material, a material that is rigid yet moldable and is safe and convenient for use with an infant 11 is desirable. For example, the frame may be made of plastic since plastic is rigid, can be injected molded, is easily cleaned, is lightweight and is inexpensive. Other materials for the frame 22, however, are possible. The frame 22 is preferably about 11/16 of an inch wide and about ¼ of an inch thick.

The frame 22, either in its entirety or limited to the portion that does not contact the sleep surface 12, may be covered with a cover material 34, preferably in sleeve form. The cover material 34 may additionally cover a pad 36 placed over the frame 22 for cushioning the plastic or other rigid material of the frame 22. Thus the cover material 34 may serve a protective cushioning function for inadvertent contact of the head 10 of the infant 11 with the plastic or other rigid material of the frame 22. The cover material 34 is preferably aesthetically acceptable and easily laundered or cleaned and may be made of material commonly used in infant clothing such as cotton, flannel, etc. While the apparatus 20 will function without the optional cushioning pad 36 and cover material 34, these embodiments offer to the infant 11 and caregiver a sense of softness and protection against bumping therefrom.

The porous support material into which the head 10 of the infant 11 will be placed may be any flexible material with some degree of elasticity. In a preferred embodiment, the support material is a net 38 and the net 38 is preferably elastic. The net 38 is defined herein as an openwork fabric with threads 42 that are woven, knotted or twisted together at regular intervals to form a mesh or open weave structure 40. The threads 42 are non-interstitial areas that define interstices 44. Preferably, the sizes of the interstices 44 are not larger than about ⅛ of an inch. The net 38 is attached to the frame 22 in any manner that allows adjustment of the degree of tension and support from the net 38 while still maintaining secure attachment of the net 38 to the frame 22.

In one embodiment the net 38 completely encloses the frame 22, and the tension in the net 38 is adjusted by manually stretching the net 38 so as to provide a tighter or looser fit about the frame 22. The net 38 is fastened to the frame 22 to secure the net 38 at the desired tension by using, for example, VELCRO® (a fastening tape consisting of opposing pieces of nylon fabric, one with tiny hooks and the other with a dense pile that interlock when pressed together) hooks 45. In this embodiment, the net 38 may attach to VELCRO® hooks 45 on the bottom portion 26 of the frame 22 and on the underside of the top portion 28 (not shown) of the frame 22. Alternatively, the net 38 may be fastened to the frame 22 or covering material 34 by other fastening means such as tying, pinning, snapping, taping, etc.

In another embodiment, the net 38 is attached to the frame 22 only at the top portion 28 of the frame 20 and is suspended in a hammock-like fashion between the sides of the top portion 28 of the frame 22. In this alternate 20 embodiment, the tension in the net 38 is adjusted by the degree of slack in fastening the net 38 to the top portion 28 of the frame 22. The net 38 or other porous material may be fastened by using VELCRO® hooks 45 positioned on the sides (not shown) of the top portion 28 of the frame. The net 38 may also be fastened to the frame 22 by other fastening means as previously described. In still another alternate embodiment, the net 38 can be shaped like a sack with a drawstring closure, allowing the net 38 to be stretched over the frame 22, closed and adjusted so that an infant's 11 head 10 when laid therein is supported just above, or just barely touching, the underlying sleep surface 12.

The net 38 or other porous material must support a weight of about 1.2 pounds to about 5 pounds, which is the weight range of the head 10 of a full term newborn to about four month old infant 11. One embodiment of the invention comprises more than one net 38, with a first net 38 capable of supporting a lighter weight range and a second net 38 capable of supporting a heavier weight range. As the infant 11 grows and passes a preestablished weight threshold the first net 38, capable of supporting the infant's 11 head 10 in the lighter weight range, is removed from the frame 22 and is replaced by the second net 38, capable of supporting the infant's 11 head 10 in the heavier weight range. For example, a first net 38 capable of supporting a weight of an infant's 11 head 10 in the range of about 1.2 to about 3 pounds may be used for a newborn infant 11. A second net 38 capable of supporting a weight of an infant's 11 head 10 in the range of about 3 to about 5 pounds is used for an older infant 11. The decision of which net 38 to use may be based a chart, nomogram, or similar extrapolation device to determine the weight of an infant's 11 head 10 from his or her body weight. This would allow the caregiver to easily select the appropriate net 38 to use with the apparatus 20. It will be appreciated that the net 38 or other porous material can be readily replaced with a fresh net 38 capable of supporting the same head 10 weight should the net 38 become damaged or soiled.

Figure 3:
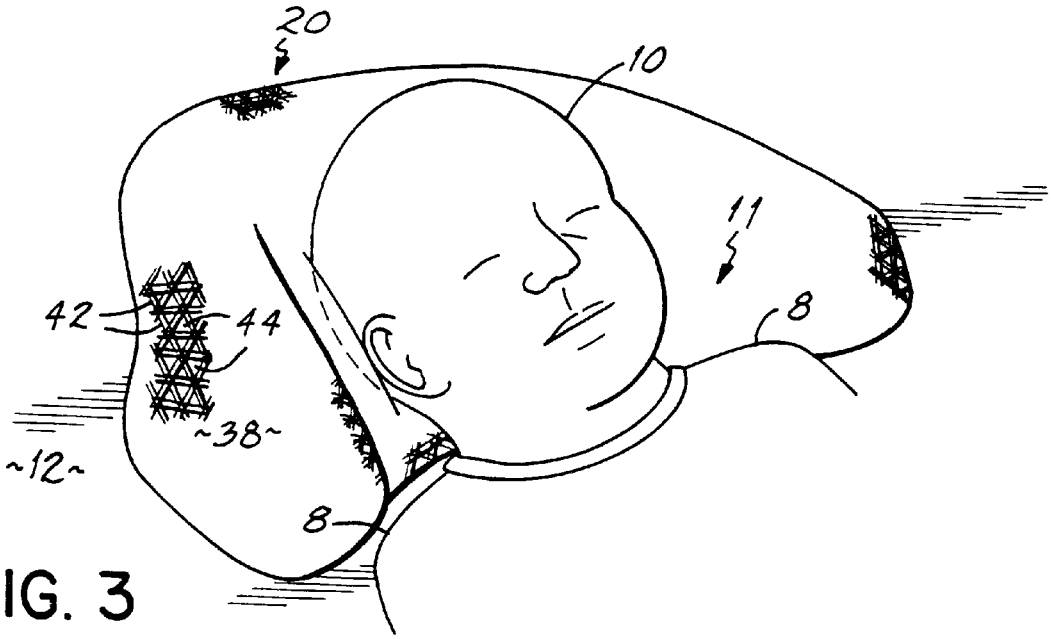
FIG. 3 is a perspective view of the apparatus of FIG. 2 shown supporting the head of an infant.

With reference to FIG. 3, one embodiment of the apparatus 20 in use to support the head 10 of an infant 11 lying in a supine position on a sleep surface 12 is shown. The frame 22 preferably has a cover 34 and a net 38 encloses the entire frame 22. The tension in the net 38 is adjusted by stretching the material tighter or looser about the frame 22 and securing with a VELCRO® hook fastener 45. The infant's 11 head 10 is thus suspended therein with a peripheral friction fit around the head 10 so that the occiput 14 that ordinarily contacts the sleep surface 12 is suspended in the net 38 and just touching the sleep surface 12, thereby removing any area of localized loads on the occiput 14. In another embodiment, a tension is applied to the net 38 such that the head 10 is suspended just above an underlying sleep surface 12.

The net 38 supplies areas of either concentrated pressure in the non-interstitial areas 42 of the net 38 or no pressure at the net 38 interstices 44.

While the net 38 must exhibit some elasticity, a net 38 that is overly elastic is not desirable. This is because of the difficulty in placement and removal of the infant 11 from the apparatus 20, as well as the compression the net 38 would exert on the head 10 of the infant 11 around the area of the head 10 contacting the non-interstitial areas 42 of the net 38.

Depending upon the size and weight of the infant's 11 head 10, the tension in the net 38 should be adjusted so that the net 38 is dispersed to cover a surface area of the head 10 of about six square inches to about twenty-five square inches. At this tension, the force on the infant's 11 head 10 will be in the range of about 0.2 to about 0.6 pounds per square inch (psi) and will be over a maximum range of about 25% of the head 10, and preferably of about 15% to about 25% of the head 10.

In use, the caregiver need not calculate the forces or surface areas previously discussed to ensure correct use of the apparatus 20. The caregiver simply adjusts the tension in the net 38 by fastening the net 38 to the frame 22 so that when the infant 11 is placed in the apparatus 20 as described, the head 10 supported in the net 38 just touches the sleep surface 12 or, less preferably, is suspended just above the sleep surface 12. This placement provides about 15% to about 25% of the head 10 being supported by the net 38, thus spreading out the load on the head 10 over a defined range and preventing a flat spot on the occiput 14 due to a localized load.

Figure 4:
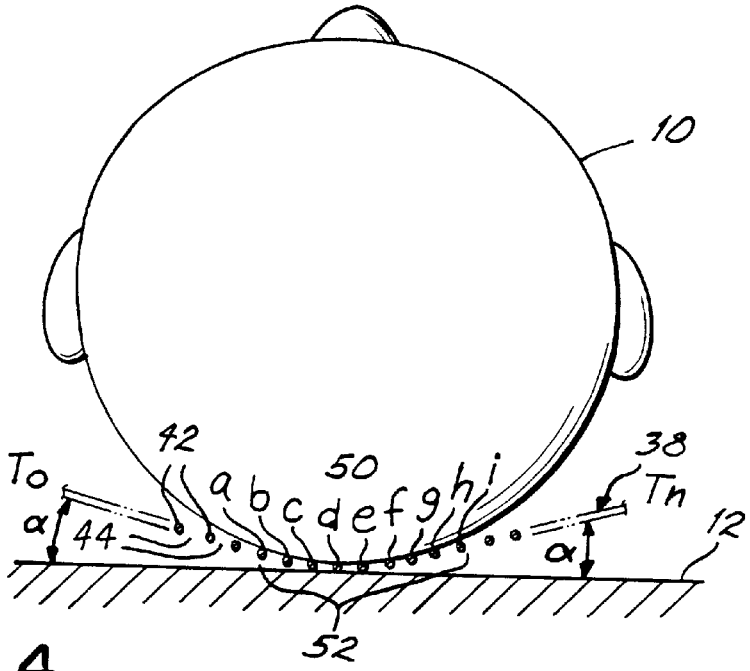
FIG. 4 is a schematic two-dimensional representation of an infant's head supported on a line of netting to illustrate one aspect of the invention.

With reference to FIG. 4, an analysis of a two-dimensional cross-section of an infant's 11 head 10, modeled as a sphere, with the infant 10 lying in a supine position on the apparatus 20 is shown. This type of engineering analysis has been performed to provide an understanding of the potential feasibility of the proposed apparatus 20. To compute the areas of localized loads from the non-interstitial areas 42 of the net 38 on the head 10 of the infant 11, the line of contact between the net 38 and the head 10 is divided into a plurality of discrete nodes 50*a–i*. The nodes 50*a–i* can be numbered sequentially across the area of the head 10 that contacts the non-interstitial regions 42 of the net 38 to form a contact interface 52. A load diagram can then be constructed for an arbitrary node, for example, node 50*a*. The loads consist of the tension $T_i$ in the net 38, directed tangent to the contact interface 52 at that node 50*a*; the tension $T_{i+1}$, directed tangent to the interface at the next adjacent node 50*b*; the load perpendicular to the contact interface at the node 50*a*, $\mathcal{P}''_i R\Delta\theta$, where $\mathcal{P}''_i$ is the perpendicular load per unit length, R is the contact interface radius of curvature at the node 50*a*, and $\Delta\theta$ is the angle subtended between the given node 50*a* and the adjacent node 50*b*; and the load due to friction between the head 10 and net 38, $\mu\mathcal{P}''_i R\Delta\theta$, which is equal to the perpendicular load multiplied by the friction coefficient. The loads are then summed in tangent and perpendicular directions at the node 50*a*. Under static equilibrium, both of these sums equal zero and take the following forms $$\Sigma F_{tangent} = T_1 - T_{i+1}\cos(\Delta\theta) - \mu\mathcal{P}''_i R\Delta\theta \quad (1)$$

$$\Sigma F_{perpendicular} = T_{i+1}\sin(\Delta\theta) - \mathcal{P}''_i R\Delta\theta \quad (2)$$

Equation (1) and (2) are solved for $T_{i+1}$ which yields $$T_{i+1} = \frac{1}{\cos\Delta\theta}T_i - \frac{1}{\cos\Delta\theta}\mu\mathcal{P}''_i R\Delta\theta \quad (3)$$

$$T_{i+1} = \frac{1}{\cos\Delta\theta}\mathcal{P}''_i R\Delta\theta \quad (4)$$

Equating the right hand sides of equations (3) and (4) and then rearranging yields $\mathcal{P}''_i$ as $$\mathcal{P}''_i = \frac{T_i \tan\Delta\theta}{R\Delta\theta(1 + \mu\tan\Delta\theta)} \quad (5)$$

Consequently, $\mathcal{P}''_i$ can be determined from equation (5) if the tension in the net 38 $T_i$ at that node 50*a* is known. Subsequently, the tension at the next node 50*b*, $T_{i+1}$, can be computed from equation (4). The computation sequence can then be repeated. This iteration sequence, however, requires knowledge of tension of the net 38 at an initial node 50*a* in order to be initiated.

If two nodes 50*a*, 50*i* are designated at the edges of the contact interface 52 on the left 50*a* and right 50*i* sides of the net 38, then the tension of the net 38 at these nodes 50*a*, 50*i* can be determined independently from the iterative process via an overall loading diagram on the head 10. Summing vertical forces yields $$\Sigma F_{vertical} = 2T_0 \sin\alpha - W \quad (6)$$

where $T_0$ is the tension of the net 38 at node 50*a*, and a is the angle of the direction of the net 38 tension with respect to horizontal, at node 50*a*, and W is the weight of the head 10. From this relationship, $T_0$ can be determined as $$T_0 = \frac{W}{2\sin\alpha} \quad (7)$$

Examination of equations (3) and (4) indicates that for non-zero friction coefficient $\mu$, $\mathcal{P}''_i$ will be largest at the edges 50*a*, 50*i* of contact area 52 and will decrease away from the edges of contact 50*a*, 50*i*. When $\mu$ is equal to zero, $\mathcal{P}''_i$ is the same for all nodes i 50*a–i*. Consequently, a more even distribution of loading is obtainable with $\mu$ as low as possible.

Accordingly, it will be appreciated that the invention provides an apparatus 20 and method of using the apparatus 20 to prevent positional plagiocephaly, also called PWS, in infants 11. The infant's 11 head 10 is comfortably supported by spreading out the support forces over a wide surface area of the head 10. The head 10 is thus not subjected to any support force sufficient to flatten any portion of the occiput 14 when the infant 11 is placed in the supine position, as for sleeping.

From the above disclosure of the general method of the present invention and the preceding summary of the preferred embodiments, those skilled in the art will readily comprehend the various modifications to which the present invention is susceptible without departing from the scope of the invention. For example, the frame 22 may be configured so its width W dimension can be adjusted to accommodate a sleep surface 12 narrower than a standard size crib such as, for example, a stroller or a changing table. As still another example the materials of which the apparatus is constructed can vary. Therefore, applicants desire to be limited only by the scope of the following claims and equivalents thereof.

What is claimed is:

1. A method of preventing positional plagiocephaly in a human infant comprising the steps of:

supporting the head of an infant in a flexible porous material wherein the head is partially surrounded by said material and distributing support forces acting on the head through said material over a surface area of the head in the range of about six square inches to about twenty-five square inches.

2. A method as in claim 1 wherein said material is suspended above a sleep surface and across a frame and wherein the method comprises supporting the head in a position between the frame and said sleep surface and just touching said sleep surface.

3. A method as in claim 1 wherein said material is suspended above a sleep surface and across a frame and wherein the method comprises supporting the head in a position between the frame and said sleep surface and just above said sleep surface.

4. A method as in claim 1 including the step of adjusting tension in said material across said frame to distribute forces over a portion of the head.

5. A method as in claim 4 wherein said forces are distributed over about 15% to about 25% of the surface area of the head.

6. A method as in claim 1 including supporting the head of an infant on said material with a force not exceeding about 0.2 to about 0.6 pounds per square inch (psi) for any portion of the surface area of the head touching said material.

7. A method of preventing positional plagiocephaly in a human infant comprising the steps of:

disposing a flexible porous material across a frame and over a sleep surface;

positioning the infant in a supine position on said surface with the back of the head of the infant lying on said material; and supporting the head through the suspension of said material distributing support forces over a surface area of the head in the range of about six square inches to about twenty-five square inches.

8. The method of claim 7, wherein the flexible porous material is a net.

9. The method of claim 7, wherein said support material has a force in the range of about 0.2 pounds per square inch (psi) to about 0.6 psi where said material contacts any portion of the head.

10. The method of claim 7, wherein said forces are distributed over about 15% to about 25% of th e surface area of the head.

11. The method as in claim 7 wherein the tension of the porous support material is adjustable by a method selected from the group consisting of stretching, loosening, replacing and combinations thereof of said material.

12. An apparatus for preventing positional plagiocephaly in a human infant comprising:

a frame in the form of a double U shape having a top U shaped portion and a bottom U shaped portion for use on a sleep surface; and a flexible porous material fitted over said frame and providing a yieldable supporting surface for the infant's head, said top portion for supporting said porous material and said bottom portion for supporting said top portion above said sleep surface, said material being depressible by the head below said frame for supporting the head and distributing support forces over a range of about six square inches to about twenty-five square inches of the head.

13. The apparatus as in claim 12 wherein the porous material is depressible for distributing support forces over an area of about 15% to about 25% of the surface area of the head.

14. The apparatus as in claim 12 wherein said top frame portion is disposed above said sleep surface a distance of about four inches, and said material is depressible downwardly from said top frame portion to a lowest position above said sleep surface.

15. The apparatus as in claim 12 wherein a tension in said material is adjustable to provide a varying amount of support pressure on the portion of the head which it contacts.

16. The apparatus as in claim 12 wherein said material exerts a supporting force in the range of about 0.2 pounds per square inch (psi) to about 0.6 psi.

17. The apparatus as in claim 12 wherein said frame and material thereon are portable and adaptable for use on any horizontal sleep surface.

18. The apparatus as in claim 12 wherein a combination of said frame and material renders the apparatus portable and adaptable for use on any horizontal sleep surface.

* * * * *

UNITED STATES PATENT AND TRADEMARK OFFICE

CERTIFICATE OF CORRECTION

PATENT NO. : 6,052,849
DATED : April 25, 2000
INVENTOR(S) : Dixon et al.

It is certified that error appears in the above-identified patent and that said Letters Patent is hereby corrected as shown below:

Column 6,
Line 15, change "In this alternate 20 embodiment" to -- In this alternate embodiment --

Column 10,
Lines 41-43, delete claim 17 and replace it with claim 18.

Column 10,
Lines 44-46, replace claim 18 with original claim 17, which was renumbered, but never printed, as follows:

-- 18. The apparatus as in claim 12 wherein said flexible porous material is fitted over a portion of said frame. --

Signed and Sealed this

Ninth Day of July, 2002

*Attest:*

*Attesting Officer*

JAMES E. ROGAN
*Director of the United States Patent and Trademark Office*